US011607083B2

(12) United States Patent
Lavery

(10) Patent No.: US 11,607,083 B2
(45) Date of Patent: Mar. 21, 2023

(54) PORTABLE SHOWER CADDY

(71) Applicant: Anthony Joseph Lavery, Delran, NJ (US)

(72) Inventor: Anthony Joseph Lavery, Delran, NJ (US)

( * ) Notice: Subject to any disclaimer, the term of this patent is extended or adjusted under 35 U.S.C. 154(b) by 0 days.

(21) Appl. No.: 17/570,652

(22) Filed: Jan. 7, 2022

(65) Prior Publication Data

US 2022/0211220 A1 Jul. 7, 2022

Related U.S. Application Data

(60) Provisional application No. 63/134,841, filed on Jan. 7, 2021.

(51) Int. Cl.

| | |
|---|---|
| ***A47K 3/28*** | (2006.01) |
| ***A47B 43/00*** | (2006.01) |
| ***A47B 57/26*** | (2006.01) |

(52) U.S. Cl.

CPC ..... *A47K 3/281* (2013.01); *A47B 43/003* (2013.01); *A47B 57/26* (2013.01); *A47K 2201/00* (2013.01)

(58) Field of Classification Search

CPC .... A47K 3/281; A47K 2201/00; A47B 57/26; A47B 43/003; A47F 5/08

See application file for complete search history.

(56) References Cited

U.S. PATENT DOCUMENTS

| | | | | |
|---|---|---|---|---|
| 5,379,536 A * | 1/1995 | Lorenzana | D06F 81/006 108/31 |
| D651,837 S * | 1/2012 | Yang | D6/525 |
| D705,575 S * | 5/2014 | Snider | D6/566 |
| 9,113,709 B2 * | 8/2015 | Jewett | A47B 97/04 |

* cited by examiner

*Primary Examiner* — Ko H Chan

(57) ABSTRACT

A portable shower caddy includes a foldable shaft, a mounting body, a first foldable shelf, and a second foldable shelf. The foldable shaft includes a first shaft section, a second shaft section, and a locking hinge. The first foldable shelf and the second foldable shelf each includes a perforated base and a frame structure. The first shaft section and the second shaft section are foldably connected to each other by the locking hinge so that the shower caddy can arrange in between a folded configuration and an unfolded configuration via the locking hinge. The perforated base is connected within the frame structure. The mounting body is terminally connected to the first shaft section. The frame structure of the first foldable shelf is slidably positioned along the first shaft section. The frame structure of the second foldable shelf is slidably positioned along the second shaft section.

10 Claims, 7 Drawing Sheets

PORTABLE SHOWER CADDY

The current application claims a priority to the U.S. Provisional Patent application Ser. No. 63/134,841 filed on Jan. 7, 2021.

FIELD OF THE INVENTION

The present invention relates generally to bath and shower products. More specifically, a portable organizer apparatus for personal shower products.

BACKGROUND OF THE INVENTION

The various bath and shower products one use on a regular basis during their shower routine have been tried and selected for a specific reason related to personal benefits. Many of the products used are preferred due to their effectiveness in cleaning, favored because of a pleasant a scent while others provide healthful or medicinal benefits to treat a condition such as dandruff or dry skin. The same is true of other care and hygiene products such as toothpaste, shaving creams, and the selection of toothbrush and razor. All of these products are readily made available to the person in their home shower and are usually at arm's reach when taking the shower. When traveling outside of the home, these products often travel with the person to the destination. It is important that these preferred products are available when one is not in their permanent residence in the case of traveling for business or vacation, dorm residency, or temporary apartment/extended stay facility. The prominence of the COVID-19 epidemic has generated heightened awareness of the spread of germs, leading to new regiments in one's hygiene routine, such as the frequent washing of hands and the use of hand sanitizer which leads to excessive dry skin and the need to moisturize. Although hotels provide toiletries, consumers still prefer to bring and use their personal care products. The challenge of traveling with various personal products is usually in the transportation, organization, and accessibility of so many different items.

The present invention provides a novel way to compactly travel with personal products and to quickly set up an organized and accessible means to use one's shower products while traveling or when living in temporary spaces such as away at college, in an apartment, or at a gym. The present invention provides a quick and easy method to setup personal shower products in the shower in a manner that limits the potential of cross contamination. The present invention also functions as a durable and compact folding organizer that can be quickly set up in the shower for instant readiness of personal shower products.

DETAIL DESCRIPTIONS OF THE INVENTION

All illustrations of the drawings are for the purpose of describing selected versions of the present invention and are not intended to limit the scope of the present invention.

The present invention is a portable shower caddy that is a convenient organizer that allows the user to travel with their personal shower products. The present invention allows the shower products to be neatly and compactly stored within as the user can easily access them while showering.

Figure 1:
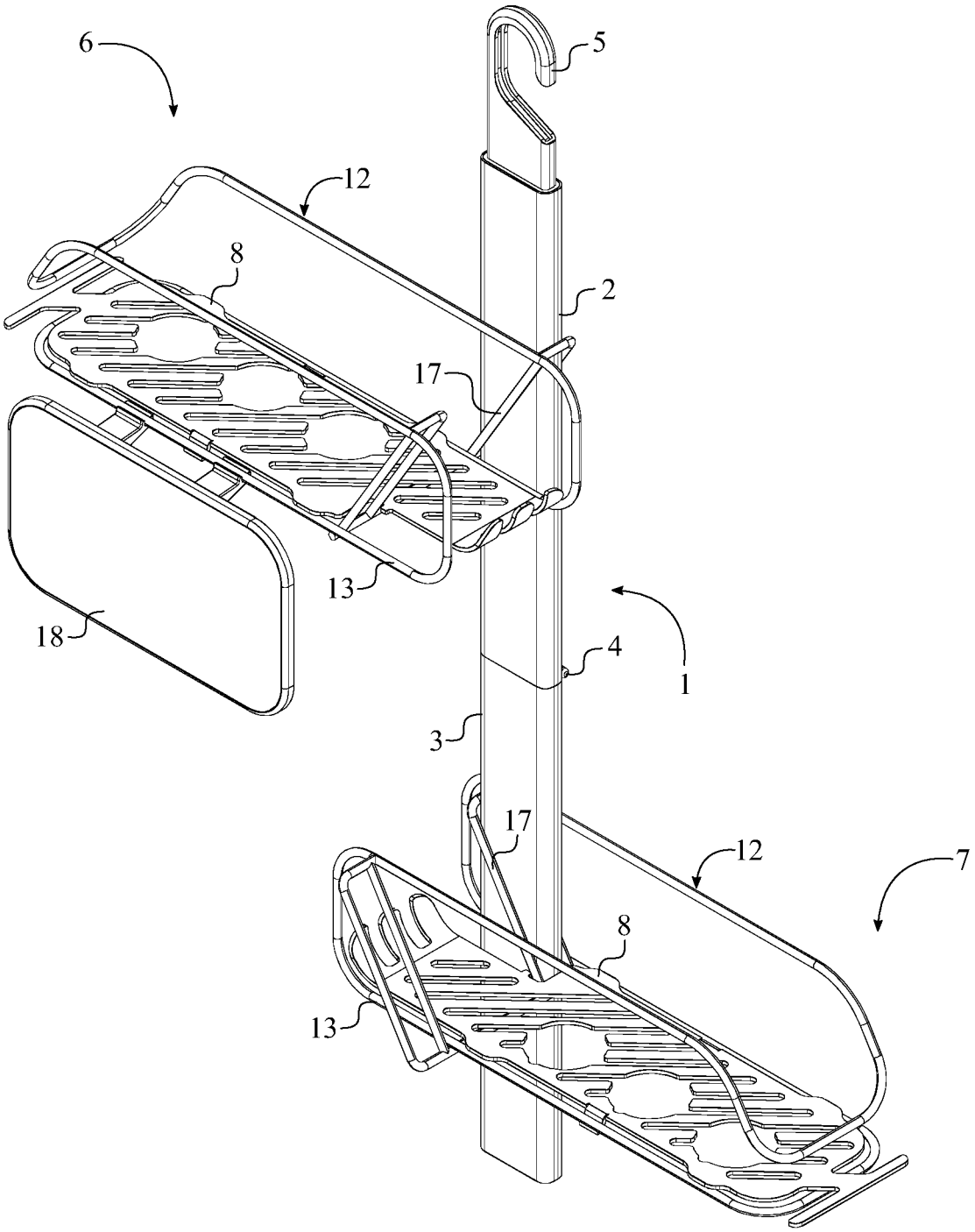
FIG. 1 is a front perspective view of the present invention.
Figure 2:
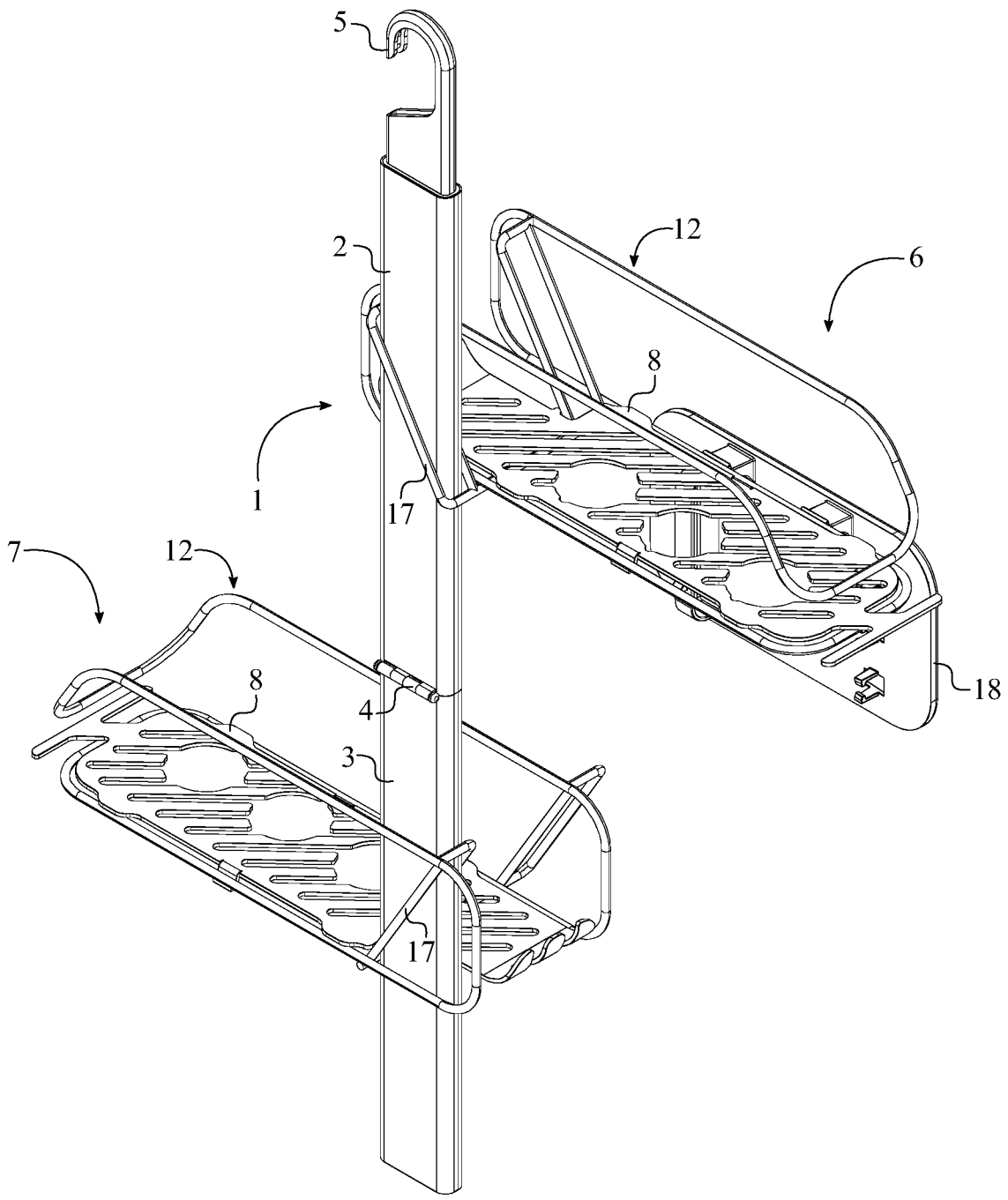
FIG. 2 is a rear perspective view of the present invention.

As shown in FIGS. 1-2, the present invention comprises a foldable shaft 1, a mounting body 5, a first foldable shelf 6, and a second foldable shelf 7. The foldable shaft 1 functions as the main structural body for the rest of the components of the present invention and comprises a first shaft section 2, a second shaft section 3, and a locking hinge 4. The first shaft section 2 and the second shaft section 3 are foldably connected to each other by the locking hinge 4 so that the foldable shaft 1 can be folded or unfolded about the locking hinge 4. The mounting body 5 is terminally connected to the first shaft section 2 and allows the foldable shaft 1 to be hang from an existing structural element such as a shower head, a wall bracket, a hanger, or any other similar supporting structures. The first foldable shelf 6 and the second foldable shelf 7 allow the user to store personal shower products along the foldable shaft 1. The first foldable shelf 6 and the second foldable shelf 7 each comprises a perforated base 8 and a frame structure 12, wherein the perforated base 8 is connected within the frame structure 12. More specifically, the frame structure 12 of the first foldable shelf 6 is slidably positioned along the first shaft section 2. The frame structure 12 of the second foldable shelf 7 is slidably positioned along the second shaft section 3. When the present invention is arranged into the unfolded configuration, the first foldable shelf 6 and the second foldable shelf 7 are positioned about the foldable shaft 1 and are held in place using the principles of cantilevered forces acting on where the first foldable shelf 6 and the second foldable shelf 7 engage with the foldable shaft 1. When the present invention is arranged into the folded configuration, the first foldable shelf 6 is folded towards the first shaft section 2 and the second foldable shelf 7 is folded towards the second shaft section 3. Resultantly, the first shaft section 2 and the second shaft section 3 can be folded toward each other via the locking hinge 4.

In reference to FIGS. 1-2 and FIGS. 5-7, the first shaft section 2 and the second shaft section 3 are elongated rigid members that facilitate the positioning of the first foldable shelf 6 and the second foldable shelf 7. When the present invention is arranged into the unfolded configuration, the first shaft section 2 and the second shaft section 3 are positioned in a linear arrangement. More specifically, a front surface of the first shaft section 2 is positioned coplanar to a front surface of the second shaft section 3. A rear surface of the first shaft section 2 is positioned coplanar to a rear surface of the second shaft section 3. As a result, the foldable shaft 1 is able to position flat against a hanging wall. When the present invention is arranged into the folded configuration, the first shaft section 2 and the second shaft section 3 are stacked on top of each other. More specifically, a rear surface of the first shaft section 2 and a rear surface of the second shaft section 3 are oriented towards each other. A front surface of the first shaft section 2 and a front surface of the second shaft section 3 oppositely oriented of each other. Furthermore, the front surface of the first shaft section 2 and the second shaft section 3 is connected to the rear surface of the first shaft section 2 and the second shaft section 3 via a first lateral surface and a second lateral surface, wherein the first lateral surface and the second lateral surface are positioned opposite of each other.

The locking hinge 4 utilized within the present invention is an industry standard hinge that opens up to 180 degrees. More specifically, the locking hinge 4 comprises a first wing, a second wing, and a connector pin with integrated locking mechanism. The first wing and the second wing are rotatably connected to each other with the connector pin with integrated locking mechanism. As shown in FIG. 2, the first wing is mounted to a terminal end of the first shaft section 2, and the second wing is mounted to a terminal end of the second shaft section 3 so that the foldable shaft 1 can arrange in between the folded configuration and the unfolded configuration. The connector pin with integrated locking mechanism prevents unintentional folding of the foldable shaft 1. For an example, when the foldable shaft 1 is arranged into the unfolded configuration, the user have to physically actuate the connector pin with integrated locking mechanism to initiate the unfolding process of the present invention. Preferably, a push-button actuated hinge is utilized as the locking hinge 4 within the present invention.

In reference to FIGS. 1-2, the mounting body 5 allows the present invention to be hung from an existing structural element. More specifically, the mounting body 5 and the locking hinge 4 are oppositely positioned of each other about the first shaft section 2 as the mounting body 5 defines the topmost component of the present invention. Preferably, the mounting body 5 is a hanging hook so that the user can easily elevate the present invention. However, the mounting body 5 is not limited to the hanging hook and can be any other types of components such as a suction cup, a ring, a strap, or an opening.

The foldable shaft 1 may incorporate an anti-sway feature at the lower most location of the foldable shaft 1. More specifically, the anti-sway feature can be mounted to the second shaft section 3 wherein the anti-sway feature and the locking hinge 4 are oppositely positioned of each other along the rear surface of the second shaft section 3. Preferably, the anti-sway feature can be a suction cup or any other type of similar component that can removably mounted the lowest most location of the foldable shaft 1.

The first foldable shelf 6 and the second foldable shelf 7 are open shelf space so that the personal shower products can be stored. In reference to FIGS. 1-2, the perforated base 8 allows water drainage to optimize functionality within the present invention. For example, proper water drainage improves the shelf life of a soap bar that is stored within the first foldable shelf 6 and/or the second foldable shelf 7. In reference to FIGS. 3-4, the frame structure 12 that is connected to the perforated base 8 comprises a base frame 13, an upper frame 14, a proximal support 15, a distal support 16, and a connector frame 17. More specifically, the proximal support 15 and the distal support 16 define the height of the frame structure 12 as the proximal support 15 is positioned adjacent to the foldable shaft 1, and the distal support 16 is positioned parallel and offset from the proximal support 15. The base frame 13 is terminally connected to the upper frame 14 by the distal support 16 and the proximal support 15 thus allowing the perforated base 8 to be connected to the base frame 13. The upper frame 14 function a barrier for some personal shower products such as tall shampoo bottles so that the aforementioned shower products may not tip over or fall out. The connector frame 17 is angularly connected to the upper frame 14 and the base frame 13, wherein the connector frame 17 is adjacently positioned to the proximal support 15. As a result, the connector frame 17 is able to slidably positioned around the foldable shaft 1 thus enabling the cantilevered positioning of the first foldable shelf 6 and the second foldable shelf 7. Due to the slidable positioning of the first foldable shelf 6 and the second foldable shelf 7, the user can easily adjust the space between the first foldable shelf 6 and the second foldable shelf 7 to store personal shower products depending upon the overall height of the personal shower products or the existing obstacles within the shower unit.

Figure 5:
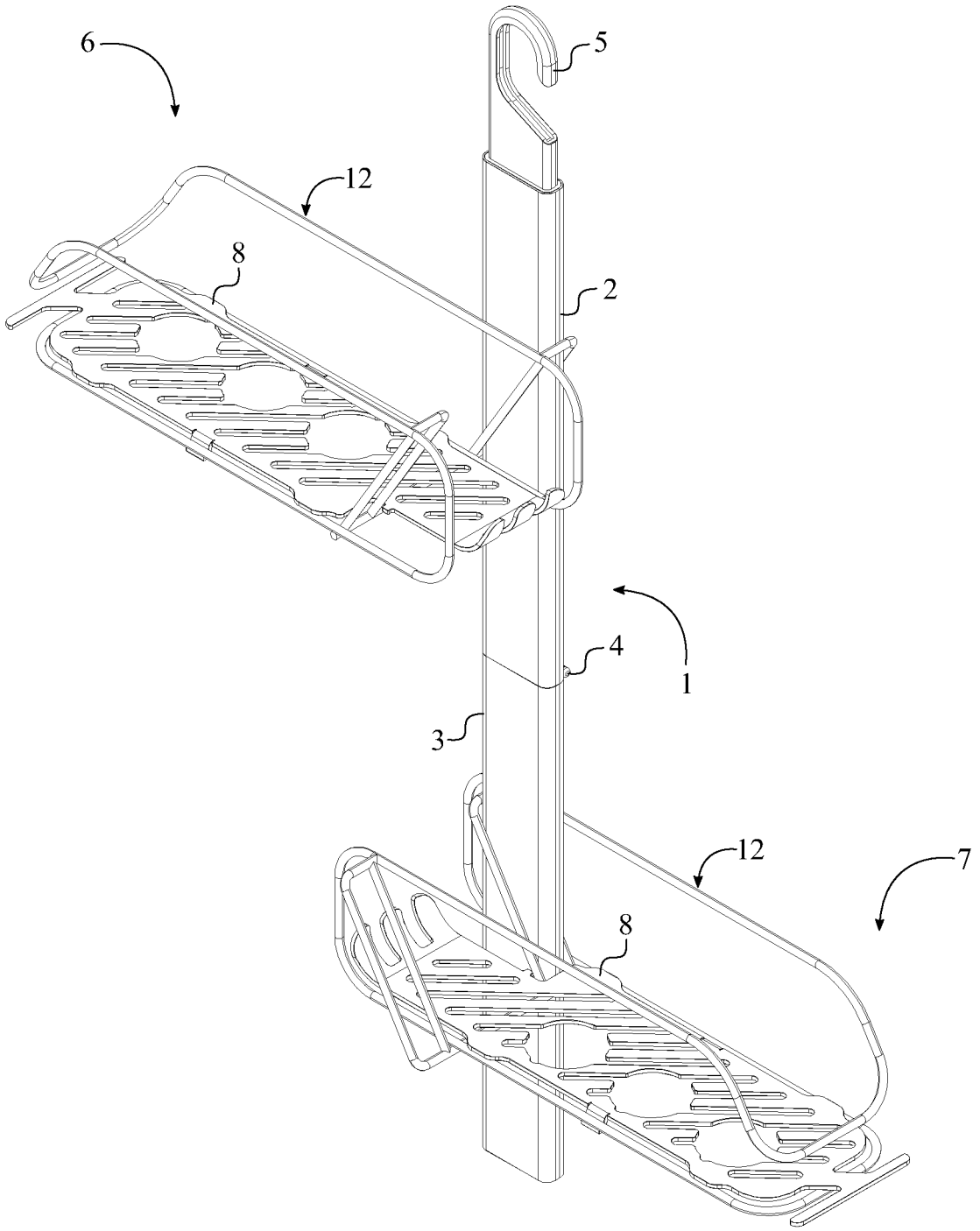
FIG. 5 is a perspective view of the present invention at the unfolded configuration.
Figure 6:
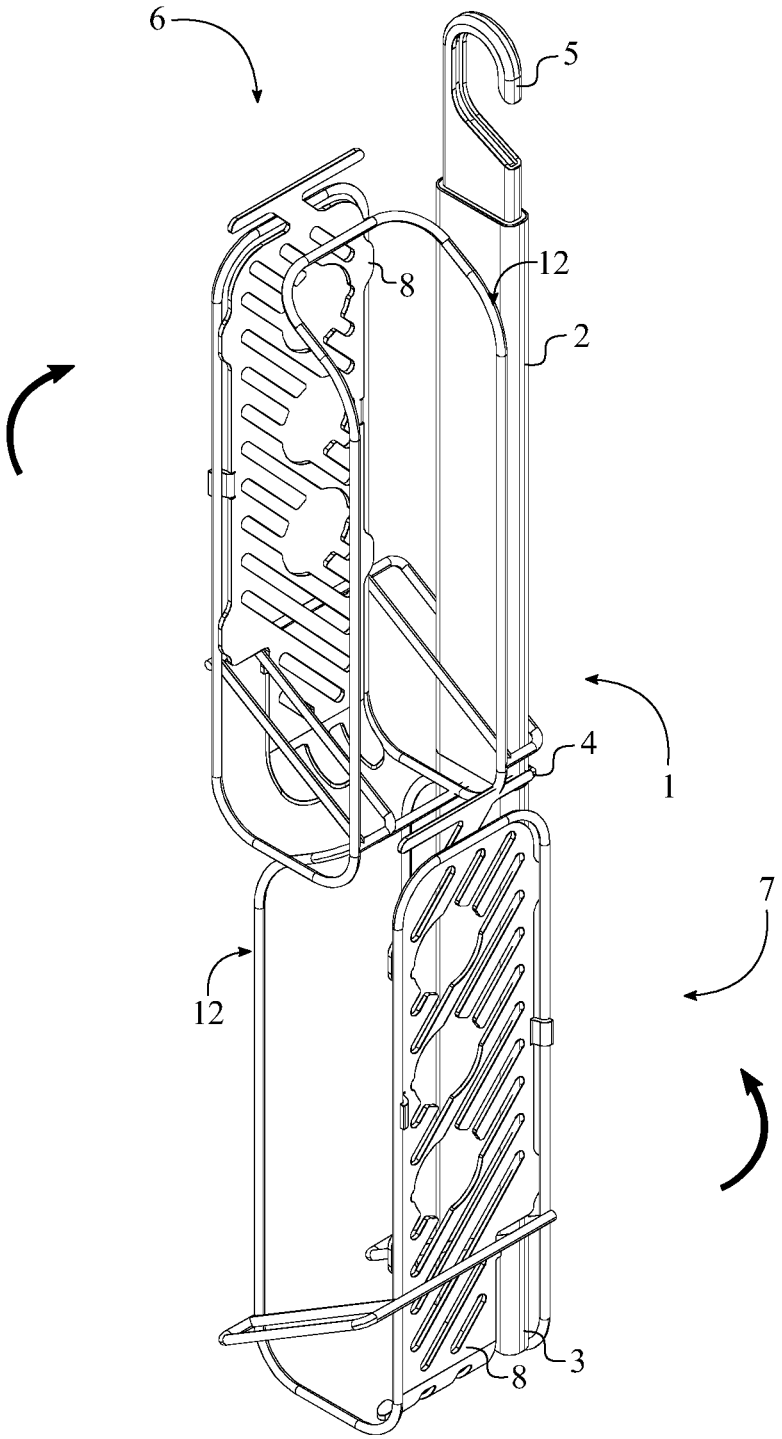
FIG. 6 is a perspective view of the present invention at the partially folded stage, wherein the first foldable shelf and the second foldable shelf are folded towards the foldable shaft.
Figure 7:
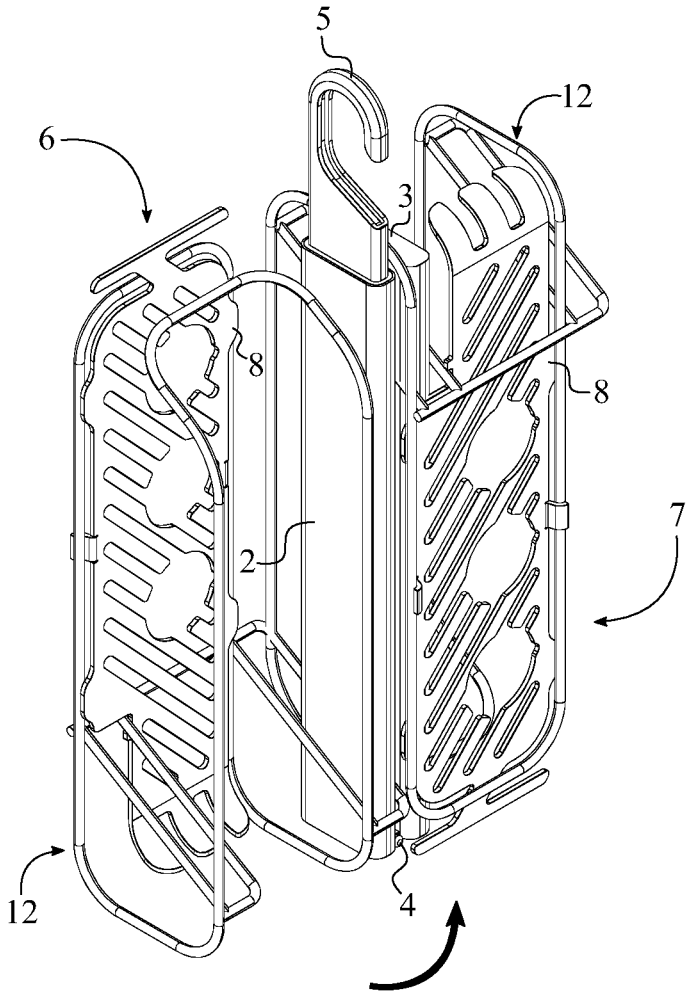
FIG. 7 is a perspective view of the present invention at the folded configuration.

In reference to FIGS. 5-6, the connector frame 17 of the first foldable shelf 6 is slidably positioned around the first shaft section 2 so that the first foldable shelf 6 can be outwardly extended from the first shaft section 2. The connector frame 17 of the second foldable shelf 7 is slidably positioned around the second shaft section 3 so that the second foldable shelf 7 can be outwardly extended from the second shaft section 3. Preferably, the first foldable shelf 6 and the second foldable shelf 7 are oppositely positioned of each other about the foldable shaft 1 to manage the weight distribution of the personal shower products. In reference to the first foldable shelf 6, the weight of the first foldable shelf 6 causes an upper cross-member of the connector frame 17 to engage with the first lateral surface while a lower cross-member of the connector frame 17 engages with the second lateral surface simultaneously. In reference to the second foldable shelf 7, the weight of the first foldable shelf 6 causes an upper cross-member of the connector frame 17 to engage with the second lateral surface while a lower cross-member of the connector frame 17 engages with the first lateral surface simultaneously.

In other words, the matched points of geometry between the upper cross-member and the lower cross-member and the perimeter geometry of the foldable shaft 1 create a frictional interference connection. The frictional interference provides a gripping force due to the length of the connector frame 17 extending beyond a sagittal plane of the foldable shaft 1. This relationship locates the center of gravity of the first foldable shelf 6 and the second foldable shelf 7 outwardly from the sagittal plane of the foldable shaft 1. The offset center of gravity of the first foldable shelf 6 and the second foldable shelf 7 provide a downward force that presses the connector frame 17 and the foldable shaft 1 to firmly grip each other creating the gripping force. The gripping force that is generated has been proven through prototypes to provide sufficient engagement to prevent the first foldable shelf 6 and the second foldable shelf 7 from inadvertently dropping or sliding down the foldable shaft 1 beyond the desired location. Increased weight applied to the first foldable shelf 6 and the second foldable shelf 7 by the personal shower products further increases the gripping forces within the present invention.

Figure 3:
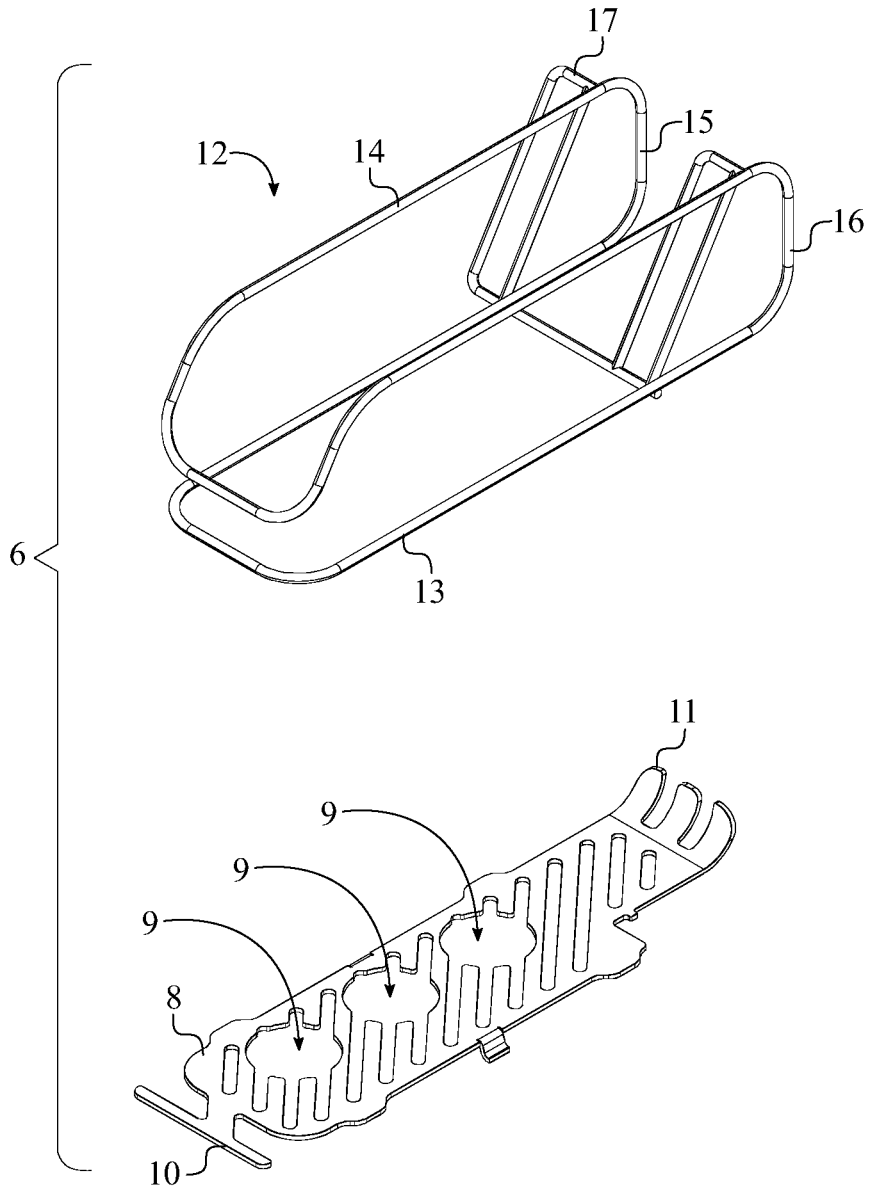
FIG. 3 is an exploded view of the first foldable shelf of the present invention.
Figure 4:
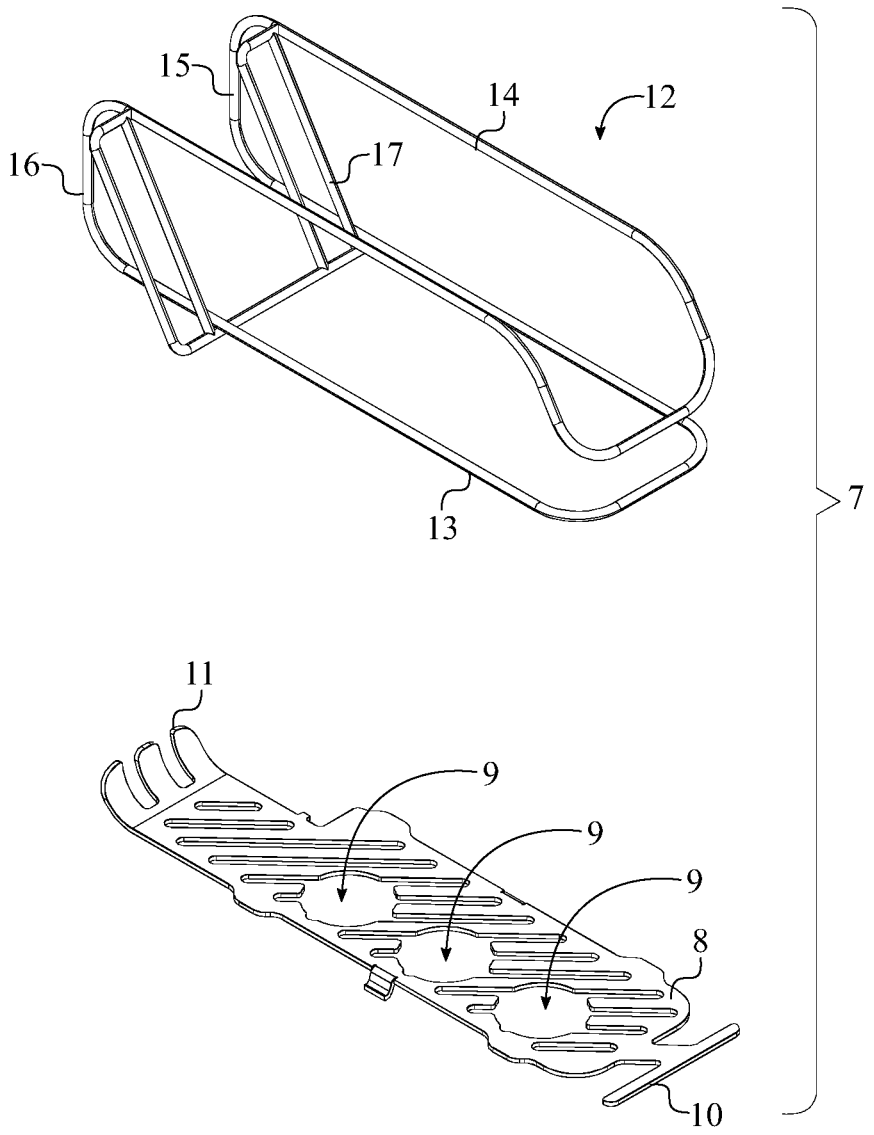
FIG. 4 is an exploded view of the second foldable shelf of the present invention.

In reference to FIGS. 3-4, the first foldable shelf 6 and the second foldable shelf 7 each further comprises at least one bottle placement opening 9 that traverses through the perforated base 8. The bottle placement opening 9 is positioned in between the proximal support 15 and the distal support 16 of the frame structure 12. The bottle placement opening 9 prevents inadvertently dropping of the bottled shower products because it is wet and sometimes slippery from being soapy. The bottle placement opening 9 is preferably sized to securely connect with the caps of travel sized bottled shower products. As a result, the bottle placement opening 9 is sized to fit over the threaded neck of a typical 3.5 oz. travel sized bottle. With the cap removed, the threaded neck is inserted through the bottle placement opening 9 and then the cap is screwed back onto the threaded neck thus sandwiching the perforated base 8 within. This is preformed when the present invention is not in use, where the user can install the filled bottled shower products in a normal orientation whereas preventing liquids from spilling out. When the cap is screwed, the bottled shower products is captured securely to the perforated base 8. When the present invention is used in the shower the bottled shower products are oriented "upside down" so that the cap and dispensing opening are facing downward. Then the user can simply flip the cap open and squeeze the container to dispense an appropriate amount of liquid in their hand, cloth, or loofa. The bottle remains securely connected during the process, eliminating the chance of the bottle falling. The present invention is preferably configured with three bottle placement openings 9 to maximize the functionality.

In reference to FIGS. 3-4, the first foldable shelf 6 and the second foldable shelf 7 each further comprises at least one hanger hook 10 that is terminally connected to the perforated base 8. Furthermore, the hanger hook 10 is offset from the foldable shaft 1 and outwardly extended from the base frame 13 of the frame structure 12. The hanger hook 10 is configured to hang specific shower items such as loofa, waterproof speakers, shower brushes, or any other similar items. As a result, the user can conveniently access these items while taking a shower.

In reference to FIGS. 3-4, the first foldable shelf 6 and the second foldable shelf 7 each further comprising a fence 11 that is terminally connected to the perforated base 8. The fence 11 is positioned adjacent to the foldable shaft 1 and positioned in between the proximal support 15 and the distal support 16 of the frame structure 12. Furthermore, the fence 11 and the hanger hook 10 are oppositely positioned of each other about the perforated base 8. The fence 11 is integrated with a plurality of cutouts so that the user can hang specific shower items such as razors and toothbrushes.

In reference to FIG. 1, the present invention further comprises a foldable mirror 18 for specific shower needs such as shaving. More specifically, the foldable mirror 18 is removably mounted to the base frame 13 of the frame structure 12 so that the user can easily access the contents within the first foldable shelf 6 and the second foldable shelf 7 without having to adjust the mirror 18. Due to the foldable feature of the mirror 18, the user can easily adjust the angle of the mirror 18 while using or folded underneath the perforated base 8 when the mirror 18 is not utilized.

Although the invention has been explained in relation to its preferred embodiment, it is to be understood that many other possible modifications and variations can be made without departing from the spirit and scope of the invention as hereinafter claimed.

What is claimed is:

1. A portable shower caddy comprising:
- a foldable shaft;
- a mounting body;
- a first foldable shelf;
- a second foldable shelf;
- the foldable shaft comprising a first shaft section, a second shaft section, and a locking hinge;
- the first foldable shelf and the second foldable shelf each comprising a perforated base and a frame structure;
- the first shaft section and the second shaft section being foldably connected to each other by the locking hinge;
- the perforated base being connected within the frame structure;
- the mounting body being terminally connected to the first shaft section;
- the frame structure of the first foldable shelf being slidably positioned along the first shaft section; and
- the frame structure of the second foldable shelf being slidably positioned along the second shaft section.

2. The portable shower caddy as claimed in claim 1, wherein the mounting body and the locking hinge are oppositely positioned of each other about the first shaft section.

3. The portable shower caddy as claimed in claim 2, wherein the mounting body is a hanging hook.

4. The portable shower caddy as claimed in claim 1 comprising:
- the frame structure comprising a base frame, an upper frame, a proximal support, a distal support, and a connector frame;
- the proximal support being positioned adjacent to the foldable shaft;
- the distal support being positioned parallel to the proximal support;
- the distal support being positioned offset from the proximal support;
- the base frame being terminally connected to the upper frame by the distal support;
- the base frame being terminally connected to the upper frame by the proximal support;
- the perforated base being connected to the base frame;
- the connector frame being angularly connected to the upper frame and the base frame;
- the connector frame being adjacently positioned to the proximal support; and
- the connector frame being slidably positioned around the foldable shaft.

5. The portable shower caddy as claimed in claim 4, wherein the connector frame of the first foldable shelf is slidably positioned around the first shaft section.

6. The portable shower caddy as claimed in claim 4, wherein the connector frame of the second foldable shelf is slidably positioned around the second shaft section.

7. The portable shower caddy as claimed in claim 1 comprising:
- the first foldable shelf and the second foldable shelf each further comprising at least one bottle placement opening;
- the bottle placement opening traversing through the perforated base; and
- the bottle placement opening being positioned in between a proximal support and a distal support of the frame structure.

8. The portable shower caddy as claimed in claim 1 comprising:
- the first foldable shelf and the second foldable shelf each further comprising at least one hanger hook;
- the hanger hook being terminally connected to the perforated base;
- the hanger hook being offset from the foldable shaft; and
- the hanger hook being outwardly extended from a base frame of the frame structure.

9. The portable shower caddy as claimed in claim 1 comprising:
- the first foldable shelf and the second foldable shelf each further comprising a fence;
- the fence being terminally connected to the perforated base;
- the fence being positioned adjacent to the foldable shaft; and the fence being positioned in between a proximal support and a distal support of the frame structure.

10. The portable shower caddy as claimed in claim 1 comprising:

a foldable mirror; and the foldable mirror being removably mounted to a base frame of the frame structure.

* * * * *